US006025809A

United States Patent [19]

Lane et al.

[11] Patent Number: 6,025,809

[45] **Date of Patent: *Feb. 15, 2000**

[54] ANTENNA RADIATING ELEMENT

[75] Inventors: Steven O. Lane, Rolling Hills Estates; Michael J. Grall, Lawndale; James M. Barker, Redondo Beach; Louis W. Hendrick, Hermosa Beach, all of Calif.

[73] Assignee: Hughes Electronics Corporation, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/127,009

[22] Filed: Jul. 31, 1998

[51] Int. Cl.[7] ..... H01P 1/17

[52] U.S. Cl. ..... 343/772; 343/756; 343/909; 333/21 R; 333/133; 333/125

[58] Field of Search ..... 343/772, 756, 343/909; 333/21 R, 133, 125, 126, 21 A, 26

[56] References Cited

U.S. PATENT DOCUMENTS

| | | | |
|---|---|---|---|
| 2,623,121 | 12/1952 | Loveridge | 333/21 R |
| 3,413,642 | 11/1968 | Cook | 343/781 |
| 3,668,567 | 6/1972 | Rosen | 333/21 A |
| 4,672,334 | 6/1987 | Saad | 333/21 A |
| 5,010,348 | 4/1991 | Rene et al. | 343/700 MS |
| 5,426,442 | 6/1995 | Haas | 343/778 |
| 5,793,334 | 8/1998 | Anderson et al. | 343/786 |

*Primary Examiner*—Don Wong
*Assistant Examiner*—James Clinger
*Attorney, Agent, or Firm*—Terje Gudmestad; Georgann Grunebach; Michael W. Sales

[57] ABSTRACT

A radiating element for an antenna incorporating a patch launcher, a bandpass filter and a polarizer all in one waveguide without the need for interconnecting individual components. The waveguide has at least one coaxial input having a patch launcher attached thereto. The inside diameter of the waveguide has a plurality of spaced apart irises that act as a bandpass filter followed by a plurality of spaced apart pins that act as a polarizer.

21 Claims, 2 Drawing Sheets

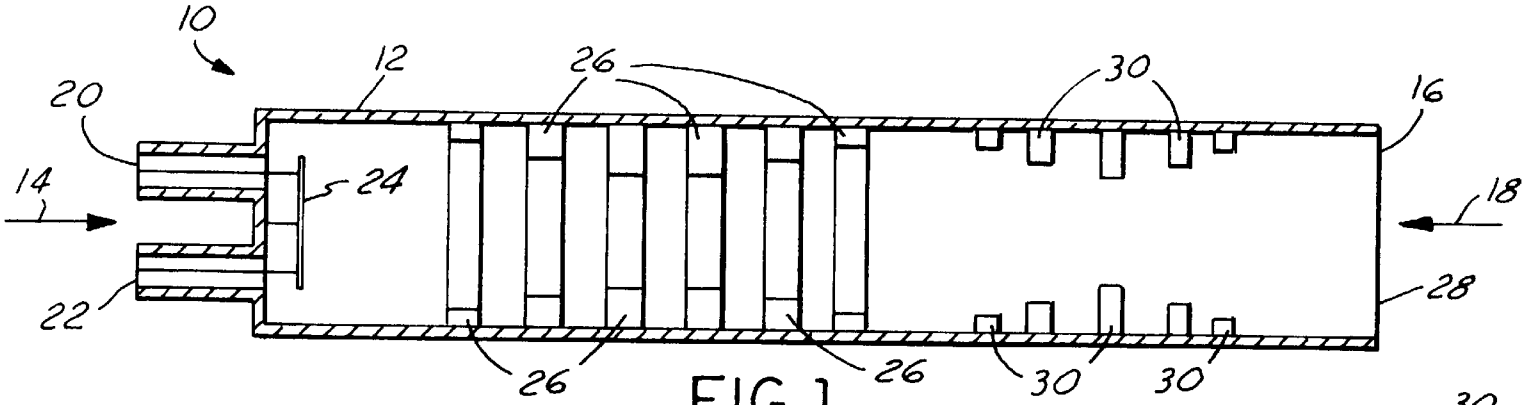
FIG. 1
FIG. 3
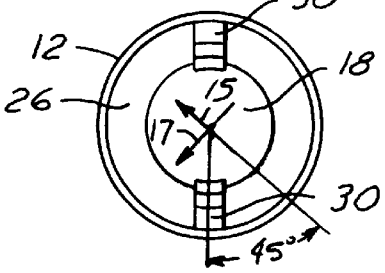
FIG. 4
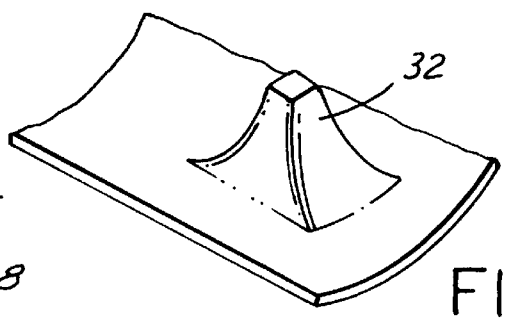
FIG. 5
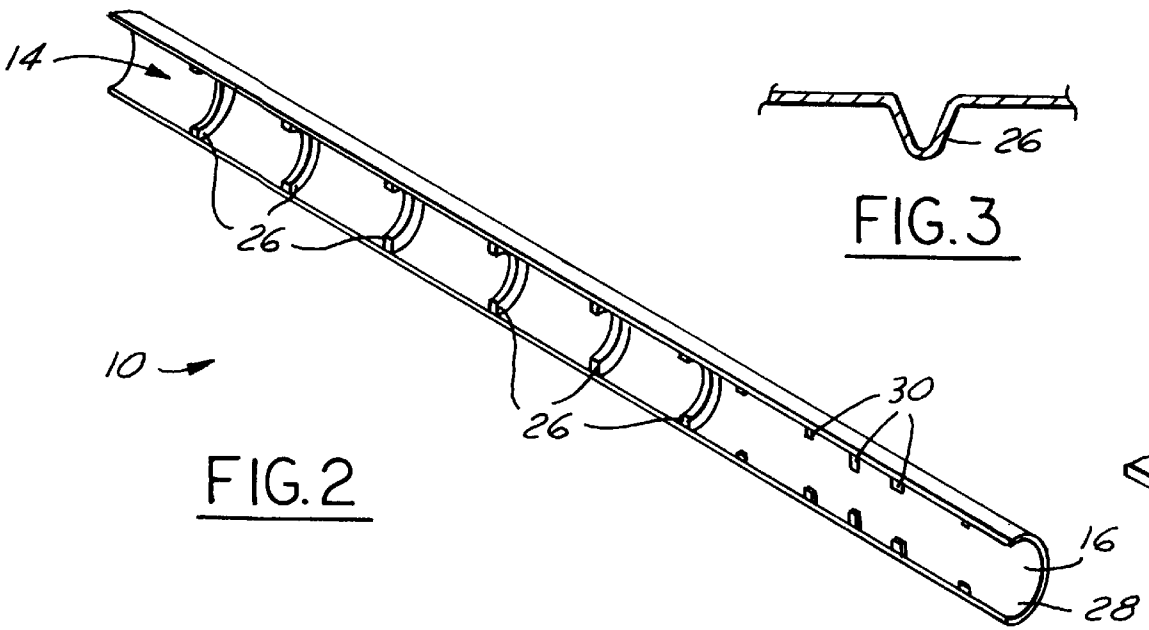
FIG. 2

ANTENNA RADIATING ELEMENT

TECHNICAL FIELD

This invention relates to antennas and more particularly to a radiating element for an antenna used in space and communications applications.

BACKGROUND ART

It is known in the art to radiate one or more signals from an antenna using a patch launcher and a polarizer in combination. However, the components are individual elements that must be interfaced with each other causing potential problems with the antenna system.

The individual elements used in combination to radiate signals add unwanted mass to the antenna system. Additionally, the elements must be individually joined, or interfaced which requires more assembly time, thereby adding cost to the antenna system. There are manufacturing tolerances for each of the individual components whereby each component introduces a small amount of reflection. The reflections are cumulative and degrade electrical Optimum performance for a radiating element requires a minimum separation distance which is not possible with individual components used in combination as in the prior art. Additionally, the individual components require attachments, flanges, etc. for interfacing with each other which adversely affects the efficiency of the radiating element.

It is an object of the present invention to eliminate the drawbacks associated with combining individual components for radiating one or more signals. It is another object of the present invention to optimize performance by achieving a minimum separation distance.

It is yet another object of the present invention to reduce the size of the radiating element resulting in higher operating efficiency and a greater scan angle range. It is a further object of the present invention to provide a single unit that is capable of radiating a signal without the need for a separate patch launcher and polarizer, thereby reducing mass, assembly time, and cost. filters the transmitted signal through a bandpass filter, and converts the linearly polarized signal to a circularly polarized signal, whereby the signal is radiated into free space.

The radiating element of the present invention is a waveguide having a detailed inner structure that transforms the signal, in the manner described above, as the signal passes through the waveguide. The inner structure of the waveguide includes at least one coaxial input at one end. A patch launcher is located at the coaxial input. At a predetermined distance from the patch launcher and inside the waveguide are a plurality of spaced apart circumferential irises that act as a bandpass filter. Also inside the waveguide is a polarizer for converting from linear to circular polarization. One example of a polarizer is a plurality of pin members spaced so that they convert the linearly polarized signal into a circularly polarized signal. Other examples are dielectric slab polarziers and squeeze sections. The end of the waveguide, opposite the end having the coaxial input, is an aperture for allowing the signal to radiate into space.

A more complete understanding of the present invention can be determined from the following detailed description when taken in view of the attached drawings and the claims appended hereto.

BRIEF DESCRIPTION OF THE DRAWINGS

FIG. 1 is a cross sectional view of the radiating element of the present invention;

FIG. 2 is a cross sectional perspective view of the radiating element of the present invention;

FIG. 3 is a view of an optional configuration for the irises of the present invention;

FIG. 4 is an end view of the radiating element of the present invention;

FIG. 5 is a partial cross-sectional perspective view of the polarizer section of the present invention having pins shaped as truncated pyramids;

BEST MODE(S) FOR CARRYING OUT THE INVENTION

Figure 6:
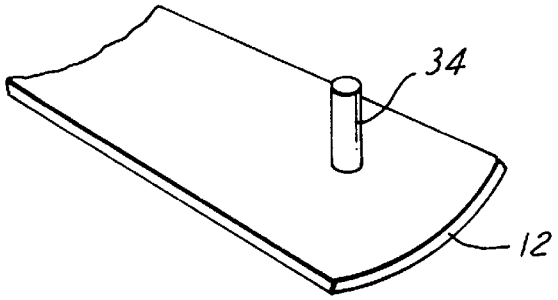
FIG. 6 is a partial cross-sectional perspective view of the polarizer section of the present invention having cylindrical pins.

The present invention will be described in conjunction with an antenna used in space and communications applications. Likewise, for clarity purposes, the present invention will be described in terms of its operation in a transmit mode. Due to the principle of reciprocity, the invention works the same in a reverse order for the receive mode.

Referring to FIGS. 1, 2, and 4 and in particular to FIG. 1 there is shown a cross section of the radiating element of the present invention 10. The radiating element includes a housing 12, which is shown as a circular waveguide, having a first end 14 and a second end 16. The housing 12 has a passage 18 therethrough. It is possible to have housing configurations other than a circular waveguide and attain similar results. For example, square, elliptical, or ridged circular waveguide could be utilized (not shown).

The first end 14 of the housing 12 has two coaxial inputs 20, 22 for receiving RF energy. Having two coaxial inputs 20, 22 allows both the horizontal and vertical polarizations of the signal to pass into the housing 12. The radiating element 10 of the present invention can operate with only one coaxial input. However, under this condition it will allow only one polarization of the signal to pass.

A patch launcher 24 is located at the first end of the housing 12. The patch launcher 24 converts the RF energy traveling from one of the coaxial inputs 20 into RF energy traveling in a circular waveguide mode. The patch launcher 24 launches a linearly polarized waveguide mode signal traveling from left to right, for example, the horizontal polarization of the signal. The orthogonal linearly polarized waveguide mode, or the vertical polarization of the signal, is launched from the other coaxial input port 22.

As the RF energy travels through the housing 12 it passes through a plurality of spaced circumferential irises 26 located inside the passageway 18 of the housing 12. The series of irises 26 functions as a bandpass filter for the RF energy as it passes through the housing 12. The frequency response characteristics of the bandpass filter are determined based upon a predetermined number of irises 26, predetermined distances between the irises 26, varying diameters of the irises 26, and predetermined thicknesses of the irises 26.

The irises 26 have a circular inner diameter that filters circularly polarized signals as well as linearly polarized signals. The irises 26 are designed to filter specific frequencies depending upon the size of the inner diameter of each iris 26. In the present example, the inner diameter of each adjacent iris 26 varies from larger to smaller and back to larger, which is typical of bandpass filtering.

There are several possibilities for the surface shape of the inner diameter of the irises 26 that will allow the irises 26 to operate as a bandpass filter yet allow different manufacturing methods to be employed. In the embodiment shown in FIG. 2, the inner diameter has a flat surface. FIG. 3 shows an alternate embodiment in the form of a rounded surface for the inner diameter of the iris 26, allowing for manufacture by rolling or pressing.

In addition to the plurality of irises 26, a plurality of spaced apart pins 30 are located in the passageway 18 at a 45° angle to the linear polarization direction as best shown in FIG. 4. The pins 30 are configured so that a pair of pins 30 are opposing each other on opposite sides of the passageway 18. As the RF energy passes by the pins 30 it is converted from one polarization to another. Arrow 15 represents the direction of the vertical polarization while arrow 17 represents the direction of the horizontal polarization. In the present example, incident linearly polarized energy is converted to circularly polarized energy as it passes by the pins 30.

The desired bandwidth, maximum reflection allowed and the level of purity desired for the circular polarization will determine the number and length of the pins 30 used in the housing 12. Just as the series of irises 26 have varying diameters, the series of pins 30 have varying lengths. In the present example, as shown in FIGS. 1 and 2, the series of pins 30 begins with shorter length pins at one end of the housing 12, tapers to longer length pins in the middle, and then tapers back down to shorter lengths. It should be noted that the up and down taper is not required and it is also possible for the polarizer to be designed with a more random length distribution (not shown).

Figure 7:
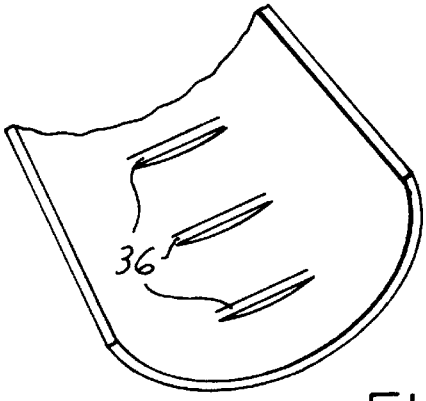
FIG. 7 is a partial cross-sectional perspective view of the polarizer section of the present invention having pins shaped as circular vanes.
Figure 8:
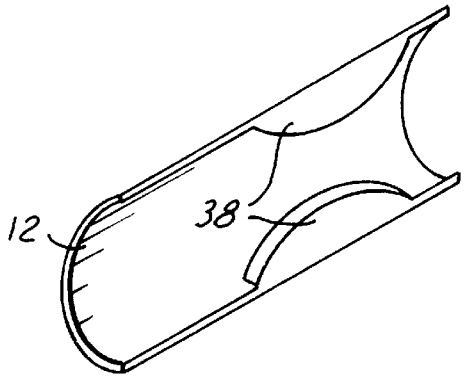
FIG. 8 is a partial cross-sectional perspective view of the polarizer section of the present invention having a continuous pin configuration.

The pins 30 may have a shape other than the square configuration shown in FIGS. 1 and 2 to allow alternative manufacturing methods while achieving the same polarization results. FIG. 5 depicts another embodiment in which the pin shape resembles a truncated pyramid 32, or trapezoidal configuration. The pins could also have a cylindrical configuration 34 as shown in FIG. 6, a circular vane 36 as shown in FIG. 7, or a continuous pin configuration 38, also known as a squeeze section, as shown in FIG. 8.

In the embodiment shown in FIGS. 1 and 2, the pins 30 follow the irises 26. However, it is possible to reverse the order of the irises 26 and the pins 30 within the housing 12 because the irises 26 are capable of filtering both circularly polarized and linearly polarized signals.

Figure 9:
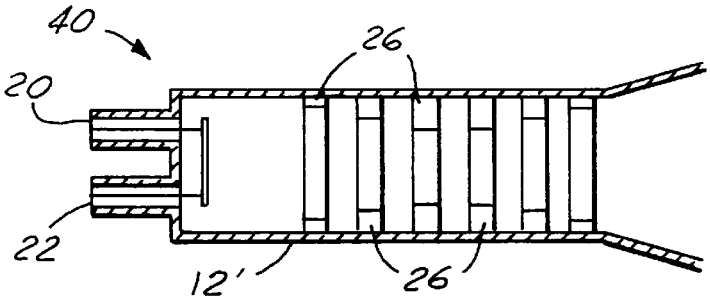
FIG. 9 is a cross-sectional view of the radiating element of the present invention having a flared aperture.

The second end 16 of the housing 12 has an aperture 28 for radiating the RF energy out of the housing 12 and into free space sufficiently filtered and polarized. The aperture can have a circular, square, or elliptical configuration. Also a flared waveguide 40 at the aperture is possible as shown in FIG. 9. The radiating element 10 of the present invention accomplishes this in a single unit as opposed to a combination of several different elements like that used in the prior art.

Figure 10:
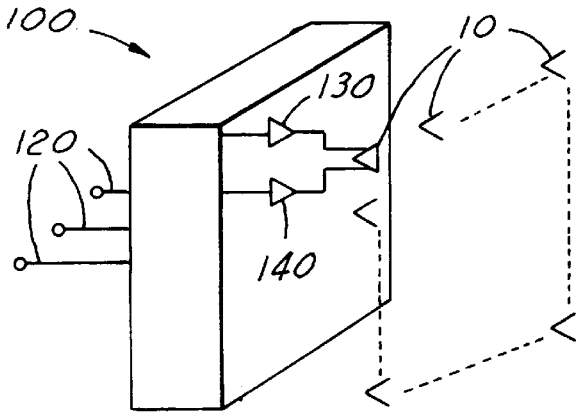
FIG. 10 is an array antenna system including a plurality of radiating elements of the present invention.

FIG. 10 is a block diagram of an array antenna system 100 including the radiating element 10 of the present invention. For example purposes, a transmitting array antenna is shown. The radiating element 10 works equally as well in a receiving antenna configuration, wherein the tranmitters are replaced with receivers. The array antenna system 100 includes a beam forming network 110, a plurality of inputs 120, a first transmitter 130 for the left handed circular polarization input, a second transmitter 140 for the right handed circular polarization input, and the radiating element 10 of the present invention. The system 100 includes an array of radiating elements 10 having two inputs, each input has a transmitter 130 (or receiver, not shown).

It is clear that the single radiating element 10 of the present invention replaces three interconnected components to accomplish similar results. By eliminating the need to interface the patch launcher, bandpass filter, and polarizer, the radiating element 10 of the present invention provides a smaller, lightweight alternative to the prior art and enhanced electrical performance.

The small, lightweight design of the radiating element 10 having reliable electrical performance is especially advantageous in space and communications applications. It should be understood that the forms of the invention herein disclosed are presently the preferred embodiments and many others are possible. It is not intended herein to mention all of the possible equivalent forms or ramifications of the invention. It is understood that the terms used herein are merely descriptive rather than limiting, and that various changes may be made without departing from the spirit or scope of the invention, as defined by the appended claims.

What is claimed is:

1. An element for radiating a signal, said radiating element comprising:

a housing having a first end, a second end and a passageway therethrough, said second end of said housing having an aperture;

at least one input port located at said first end of said housing;

a patch launcher integral to said housing and located a predetermined distance from said patch launcher;

a plurality of spaced apart irises integral to said housing and located a predetermined distance from said patch launcher; and at least one polarization member integral to said housing and located a predetermined distance from said spaced apart irises.

2. The radiating element as claimed in claim 1 wherein each of said plurality of irises has an inner diameter having a flat surface.

3. The radiating element as claimed in claim 1 wherein each of said plurality of irises has an inner diameter having a rounded surface.

4. The radiating element as claimed in claim 1 wherein said at least one polarization member further comprises a plurality of pins, and each of said plurality of pins has a square configuration.

5. The radiating element as claimed in claim 1 wherein said at least one polarization member further comprises a plurality of pins, each of said plurality of pins has a trapezoidal configuration.

6. The radiating element as claimed in claim 1 wherein said polarization member further comprises a plurality of pins, and each of said plurality of pins has a cylindrical configuration.

7. The radiating element as claimed in claim 1 wherein said polarization member further comprises a plurality of pins, and each of said plurality of pins has a circular vane configuration.

8. The radiating element as claimed in claim 1 wherein said polarization member is a continuous circular vane positioned longitudinally inside said housing.

9. The radiating element as claimed in claim 1 wherein each of said plurality of irises has an inner diameter that varies from an adjacent iris.

10. The radiating element as claimed in claim 9 wherein said inner diameter of each of said plurality of irises varies from large to small and back to large over said plurality of irises.

11. The radiating element as claimed in claim 1 wherein each of said plurality of pins has a length that varies from an adjacent pin.

12. The radiating element as claimed in claim 11 wherein said length of each of said plurality of pins varies from shorter to longer and back to shorter over said plurality of pins.

13. The radiating element as claimed in claim 1 wherein said second end of said housing has a flared aperture.

14. An element for radiating a signal, said radiating element comprising:

a waveguide having a first end, a second end and a passageway therethrough;

at least one coaxial input at said first end of said waveguide, said second end of said waveguide having an aperture;

a patch launcher integral to said waveguide and located at said at least one coaxial input;

a predetermined number of irises integral to said waveguide and spaced a predetermined distance from each other and said patch launcher; and a predetermined number of pins integral to said waveguide and spaced a predetermined distance from each other and said irises;

wherein said signal enters said waveguide through said at least one coaxial input, said signal is launched into said waveguide by said patch launcher, said signal is filtered by said irises, said signal is polarized by said pins and radiated into free space at said apterture.

15. The radiating element as claimed in claim 10 wherein each of said plurality of pins has a square configuration.

16. The radiating element as claimed in claim 14 wherein each of said plurality of pins has a trapezoidal configuration.

17. The radiating element as claimed in claim 14 wherein each of said plurality of irises has an inner diameter that varies from an adjacent iris.

18. The radiating element as claimed in claim 17 wherein said inner diameter of each of said plurality of irises varies from large to small and back to large over said plurality of irises.

19. The radiating element as claimed in claim 14 wherein each of said plurality of pins has a length that varies from an adjacent pin.

20. The radiating element as claimed in claim 19 wherein said length of each of said plurality of pins varies from shorter to longer and back to shorter over said plurality of pins.

21. A satellite system comprising:

a beam forming network; and an array of elements for radiating a signal, said radiating element comprising:

a waveguide having a first end, a second end and a passageway therethrough;

first and second coaxial inputs at said first end of said waveguide, said second end of said waveguide having an aperture;

a predetermined number of irises integral to said waveguide and spaced a predetermined distance from each other and from said first and second coaxial inputs, each of said plurality of irises has an inner diameter that varies from an adjacent iris; and a predetermined number of pins integral to said waveguide and spaced a predetermined distance from each other and said irises, each of said plurality of pins has a length that varies from an adjacent pin;

wherein said signal enters said waveguide through said first and second coaxial inputs, said signal is launched into said waveguide by said patch launcher, said signal is filtered by said irises, said signal is polarized by said pins and radiated into free space at said aperture.

* * * * *